US010358838B2

(12) United States Patent
Dominguez

(10) Patent No.: US 10,358,838 B2
(45) Date of Patent: Jul. 23, 2019

(54) FOOTING ANCHOR DEVICE

(71) Applicant: Juan Carlos Dominguez, New Salem, ND (US)

(72) Inventor: Juan Carlos Dominguez, New Salem, ND (US)

( * ) Notice: Subject to any disclaimer, the term of this patent is extended or adjusted under 35 U.S.C. 154(b) by 0 days.

(21) Appl. No.: 15/896,778

(22) Filed: Feb. 14, 2018

(65) Prior Publication Data

US 2018/0230664 A1 Aug. 16, 2018

Related U.S. Application Data

(60) Provisional application No. 62/458,909, filed on Feb. 14, 2017.

(51) Int. Cl.

| | |
|---|---|
| ***E04H 12/22*** | (2006.01) |
| ***E02D 5/54*** | (2006.01) |
| ***E02D 27/42*** | (2006.01) |
| ***E02D 27/50*** | (2006.01) |
| ***E02D 5/80*** | (2006.01) |

(52) U.S. Cl.

CPC ..... *E04H 12/2269* (2013.01); *E02D 5/54* (2013.01); *E02D 5/80* (2013.01); *E02D 27/50* (2013.01); *E04H 12/2253* (2013.01)

(58) Field of Classification Search

CPC ... E04H 12/2253; E04H 12/2269; E02D 5/54; E02D 27/42

See application file for complete search history.

(56) References Cited

U.S. PATENT DOCUMENTS

| | | | | |
|---|---|---|---|---|
| 4,572,695 | A * | 2/1986 | Gilb | E04B 1/2608 248/300 |
| 5,560,588 | A * | 10/1996 | Hilliard | E04G 21/3223 256/59 |
| 7,377,491 | B2 * | 5/2008 | Fuoco | E04F 11/1812 256/65.01 |
| 7,627,994 | B1 * | 12/2009 | Demirkan | E04H 12/2269 248/530 |
| 8,572,905 | B1 * | 11/2013 | Driggers | E02D 27/12 52/169.13 |
| 9,091,037 | B2 * | 7/2015 | Fairbairn | E02D 27/42 |
| 9,534,414 | B2 * | 1/2017 | Leary | E04H 12/2269 |
| 2007/0084137 | A1 * | 4/2007 | Pasto | E02D 27/42 52/170 |
| 2017/0022679 | A1 * | 1/2017 | Hayman | E02D 27/42 |
| 2018/0016808 | A1 * | 1/2018 | Hilliard | E04H 12/2238 |
| 2018/0230664 | A1 * | 8/2018 | Dominguez | E02D 27/50 |

* cited by examiner

*Primary Examiner* — Andrew J Triggs

(57) ABSTRACT

A footing anchor device enhances lateral stability, base support, and upheaval resistance for a footing. The device includes a base and a cradle. The base has a central section and a plurality of arms extending from the central section. Each of the arms has a bottom wall and a pair of opposed lateral walls extending upwardly from respective side edges of the bottom wall. The cradle is coupled to the base. The cradle is aligned with and extends upwardly from the central section.

1 Claim, 7 Drawing Sheets

FOOTING ANCHOR DEVICE

CROSS-REFERENCE TO RELATED APPLICATIONS

I hereby claim the benefit under 35 U.S.C. Section 119(e) of U.S. Provisional application 62/458,909 filed Feb. 14, 2017, which is in its entirety incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to anchor devices and more particularly pertains to a new anchor device for enhancing lateral stability, base support, and upheaval resistance.

BRIEF SUMMARY OF THE INVENTION

An embodiment of the disclosure meets the needs presented above by generally comprising a base and a cradle. The base has a central section and a plurality of arms extending from the central section. Each of the arms has a bottom wall and a pair of opposed lateral walls extending upwardly from respective side edges of the bottom wall. The cradle is coupled to the base. The cradle is aligned with and extends upwardly from the central section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
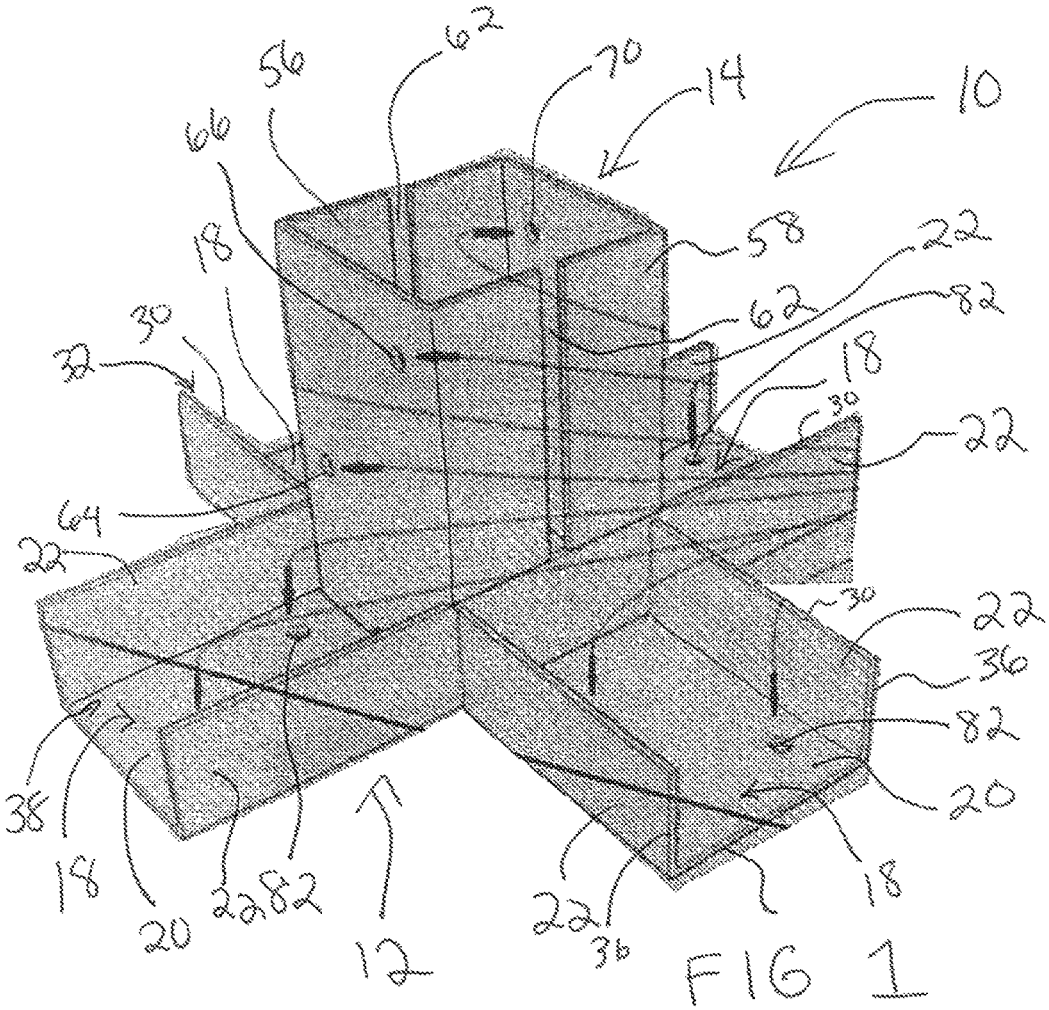
FIG. 1 is a top front side perspective view of a footing anchor device according to an embodiment of the disclosure.
Figure 2:
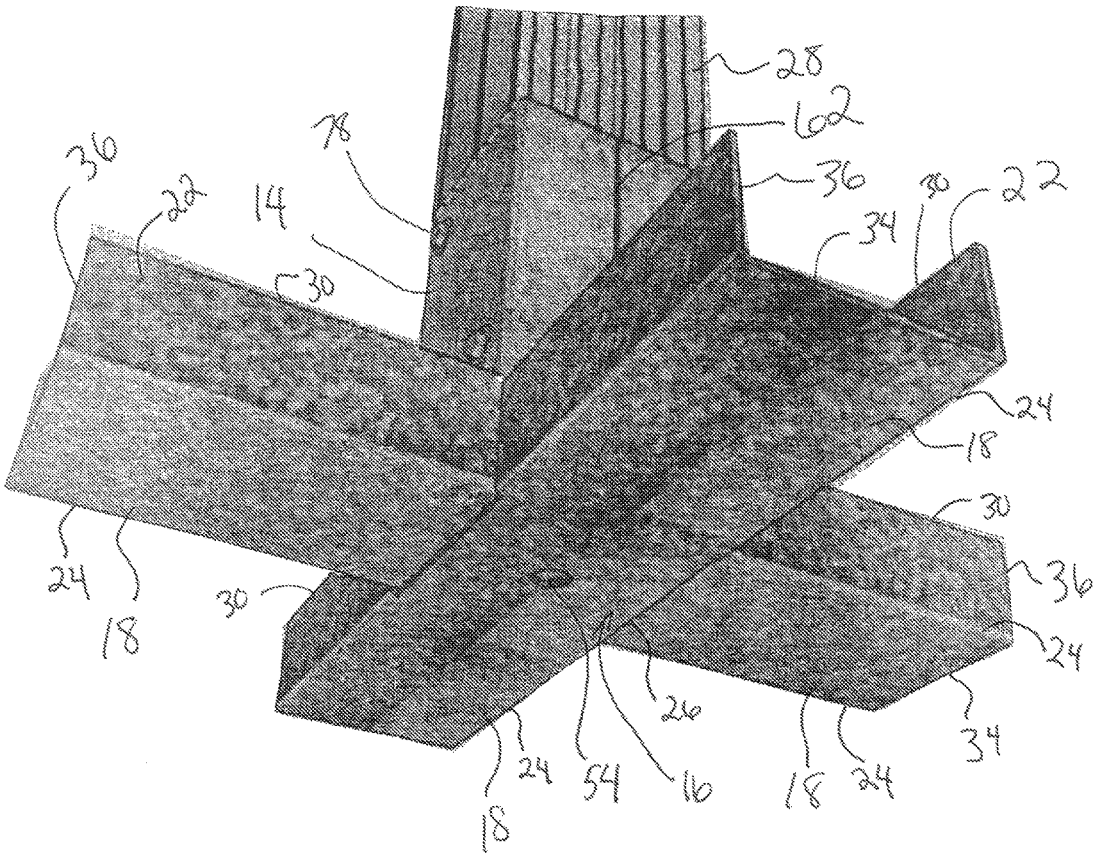
FIG. 2 is a front bottom side perspective view of an embodiment of the disclosure.

With reference now to the drawings, and in particular to FIGS. 1 through 6 thereof, a new anchor device embodying the principles and concepts of an embodiment of the disclosure and generally designated by the reference numeral 10 will be described.

As best illustrated in FIGS. 1 through 6, the footing anchor device 10 generally comprises a base 12 and a cradle 14. The base 12 has a central section 16 and a plurality of arms 18 extending from the central section 16. Each of the arms 18 has a bottom wall 20 and a pair of opposed lateral walls 22 extending upwardly from respective side edges 24 of the bottom wall 20. The central section 16 has a polygonal shape. Thus, a peripheral edge 26 of the central section has a plurality of straight side edges. As shown, the central section 16 is a square. The central section 16 is essentially shaped corresponding to the shape of a building support 28 positioned in and supported by the base 12. Each of the arms 18 extends from an associated side of the polygonal shape. Respective upper edges 30 of each of the opposed lateral walls 22 is coplanar defining a top 32 of the base 12. Each arm 18 has a distal edge 34 of the bottom wall 20 relative to the central section 16 and distal edges 36 of the opposed lateral walls 22 of the arm 18 relative to the central section 16 being coplanar. The distal edges 34 of the bottom wall 20 and the distal edges 36 of the opposed lateral walls 22 of each of the arms 18 define an open end 38 of the arm 18 opposite the central section 16. Each of the distal edges 36 of the opposed lateral walls 22 is perpendicular to the distal edge 34 of the bottom wall 20. More specifically, the base 12 may be formed by a first elongated member 40 and a second elongated member 42. The first elongated member 40 has a U-shaped transverse cross-sectional shape 44 extending a full length of the first elongated member 40. The second elongated member 42 has a pair of outer portions 46. Each of the outer portions 46 has a U-shaped transverse cross-sectional shape 48 which may be substantially equivalent in dimension to the shape of the first elongated member 40. The first elongated member 40 is positioned on the second elongated member 42 in a perpendicular orientation relative to the first elongated member 40. The first elongated member 40 has a width equal to spacing between the outer portions 46 of the second elongated member 42. Overlapping portions of the first elongated member 40 and the second elongated member 42 define the central section 16 of the base 12. When assembled, the first elongated member 40 may be coupled to the second elongated member 42 by welding or the like such that the base 12 is generally cruciform in shape with the arms 18 all being equal in length. A hole 54 extends through the central section 16 of the base 12. The hole is centrally positioned in the central section 16.

The cradle 14 is coupled to the base 12. The cradle 14 is aligned with and extends upwardly from the central section 16. The cradle 14 has first section 56 and a second section 58. Each of the first section 56 and the second section 58 is coupled to the base 12. The first section 56 is positioned opposite the second section 58 defining a channel 60 therebetween aligned with and extending up from the central section 16 of the base 12. The first section 56 is spaced from the second section 58 defining a pair of gaps 62 between the first section 56 and the second section 58 on opposite sides of the channel 62. Each of the gaps 62 is perpendicular to the central section 16 of the base 12. The first section 56 has a pair of first section apertures 64,66 extending therethrough. The pair of first section apertures 64,66 is positioned to define an upper first section aperture 66 and a lower first section aperture 64. The second section 58 has a pair of second section apertures 70,72 extending therethrough. Each of the first section apertures 64,66 extends through a medial panel 74 of the first section 56. Each of the second section apertures 70,72 extends through a medial panel 76 of the second section 58. The medial panel 76 of the second section 58 is parallel to and spaced from the medial panel 74 of the first section 56 across the channel 62. The pair of second section apertures 70,72 is positioned to define an upper second section aperture 72 and a lower second section aperture 70. The upper first section aperture 66 and the upper second section aperture 72 are laterally spaced from each other across the channel 62. The lower first section aperture 64 and the lower second section aperture 70 are laterally spaced from each other across the channel 62. The upper first section aperture 66 is vertically aligned across the channel 62 with the lower second section aperture 70. The upper second section aperture 72 is vertically aligned across the channel 62 with the lower first section aperture 64. In the configuration fasteners 78, such as long bolts, are insertable through the first section 56 and second section 58 in a generally rectangular pattern but extending alternately through opposite side of the cradle 14.

Figure 3:
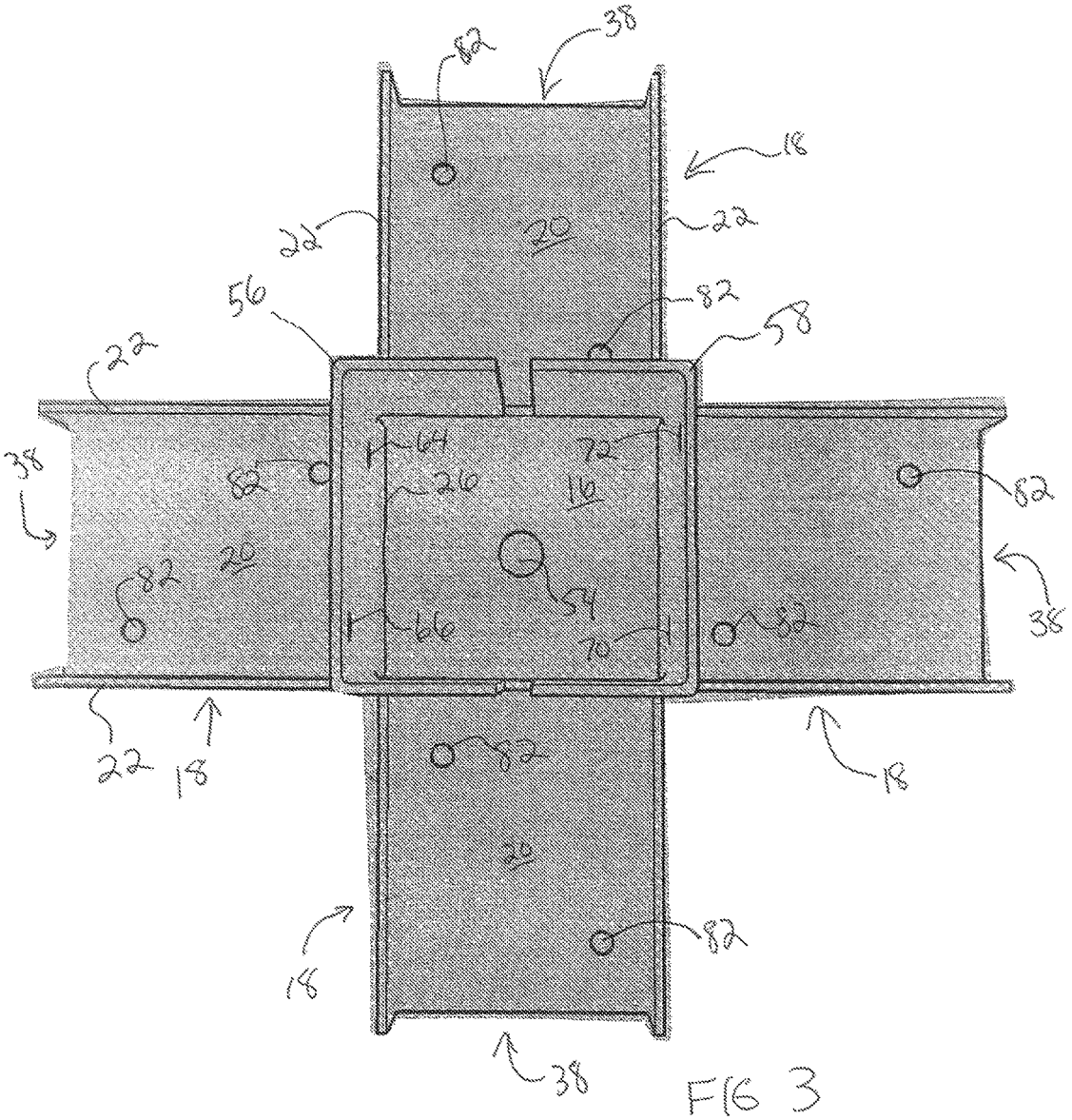
FIG. 3 is a top view of an embodiment of the disclosure.
Figure 4:
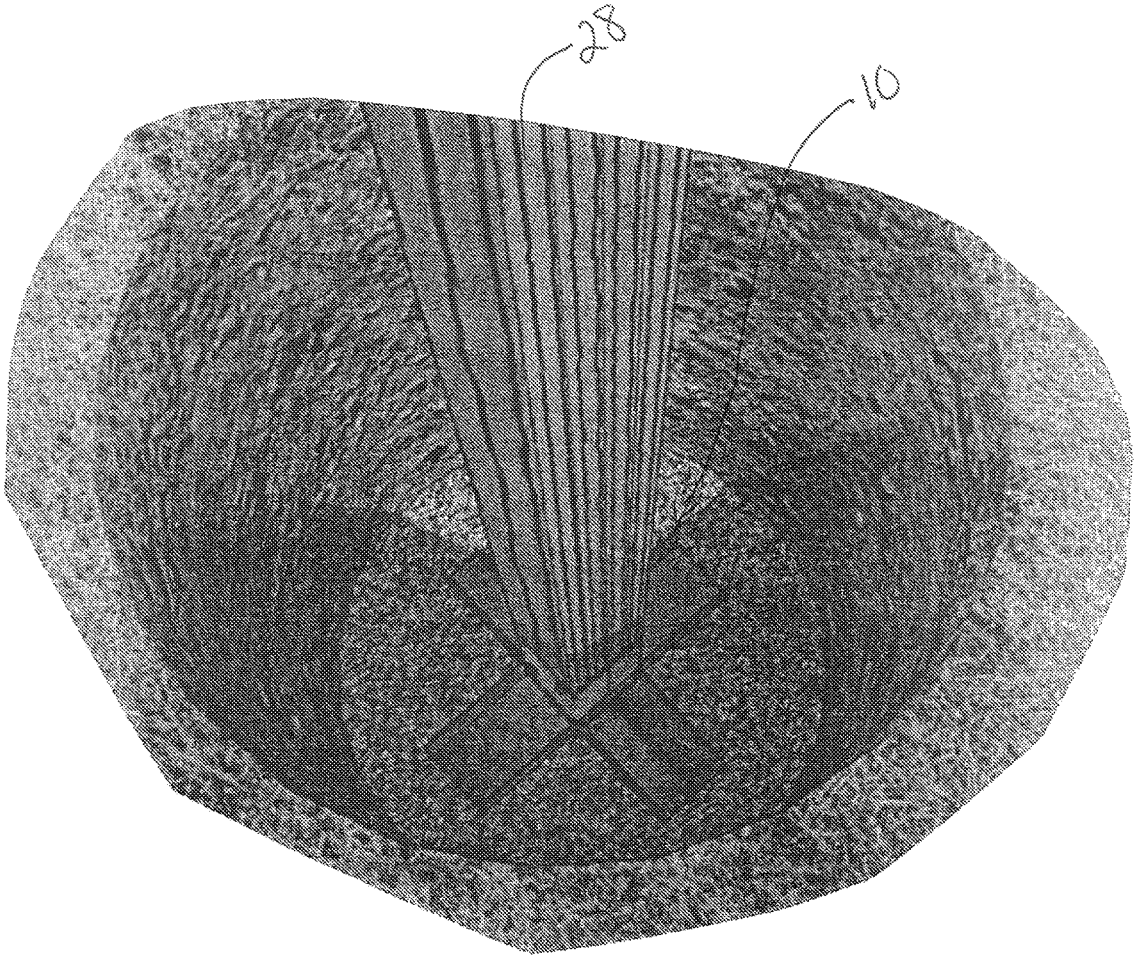
FIG. 4 is a top front side perspective view of an embodiment of the disclosure in use.
Figure 5:
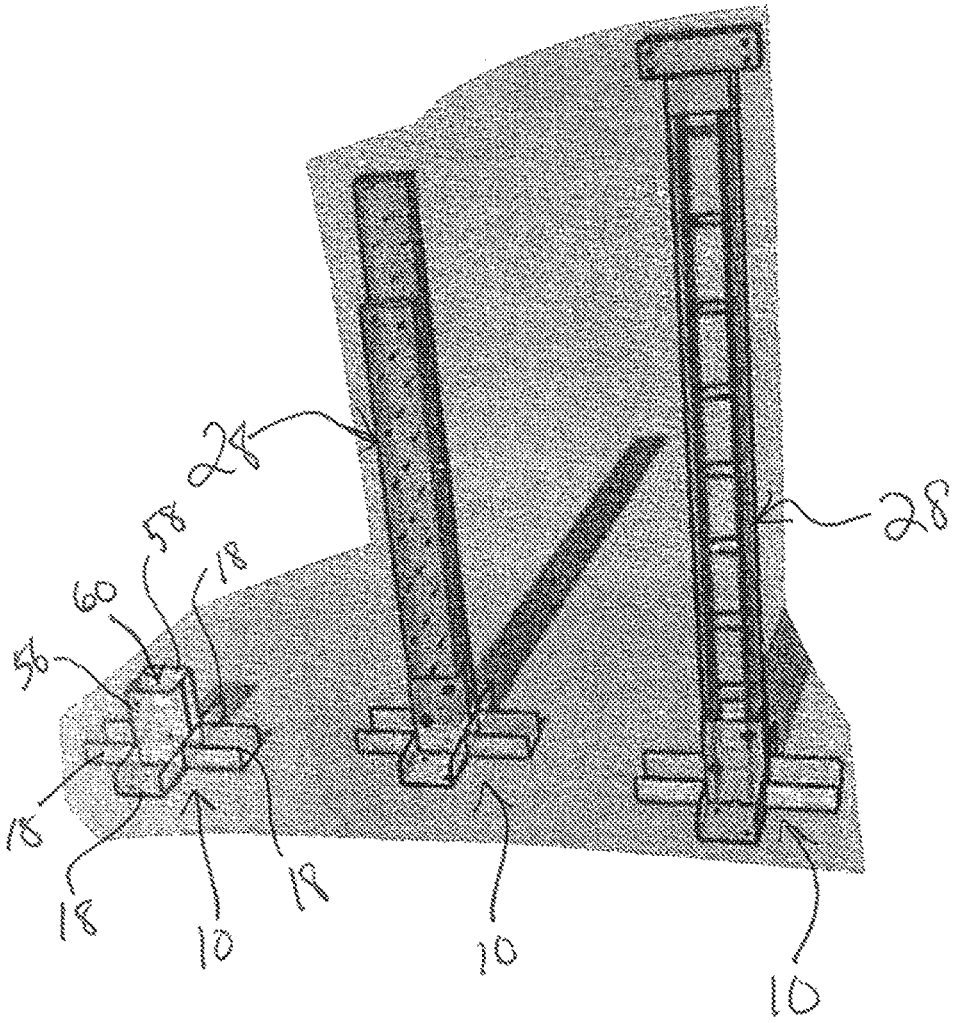
FIG. 5 is a top front view of the device in use with wood and metal building supports.
Figure 6:
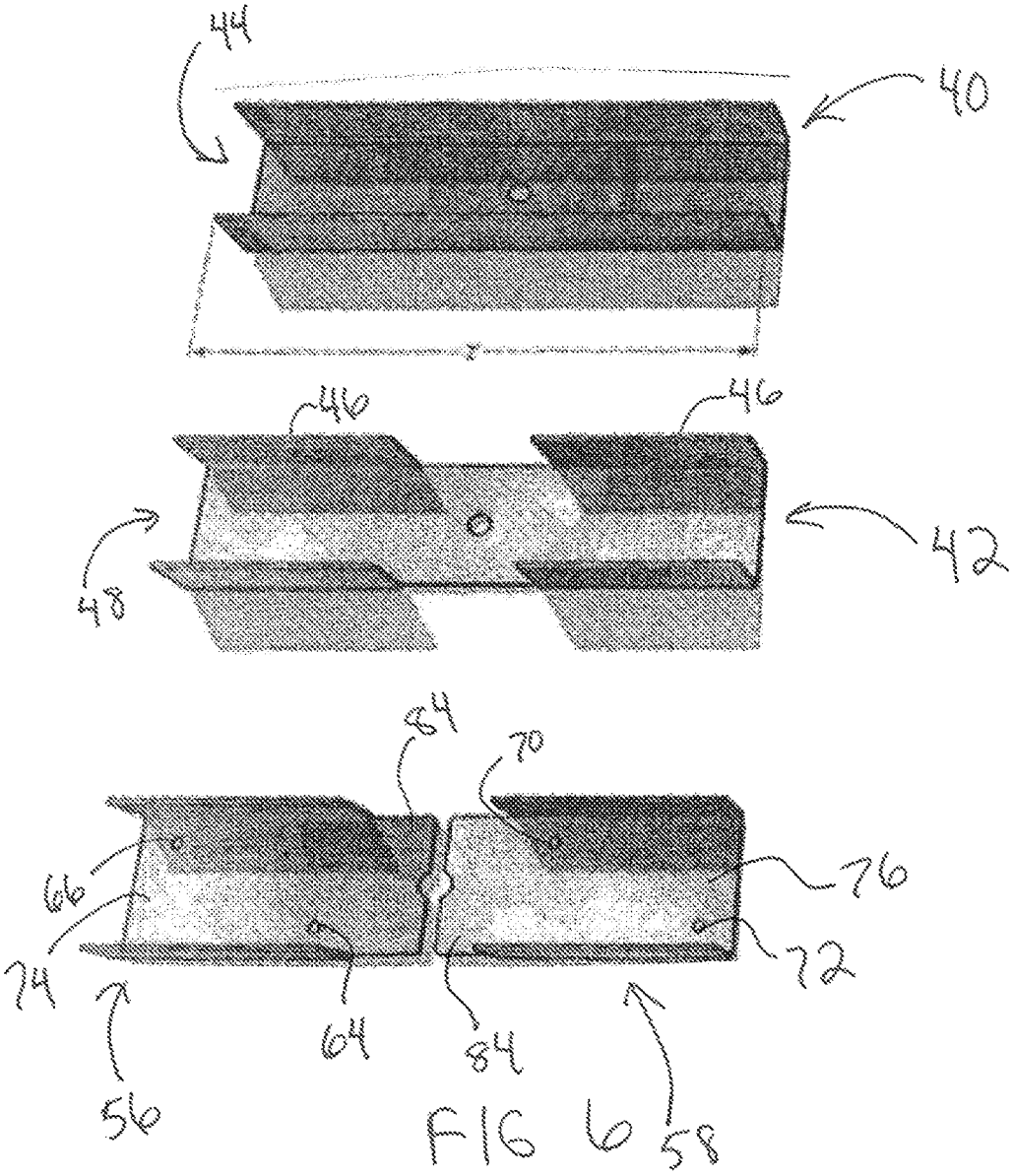
FIG. 6 is a top front disassembled view an embodiment of the disclosure.
Figure 7:
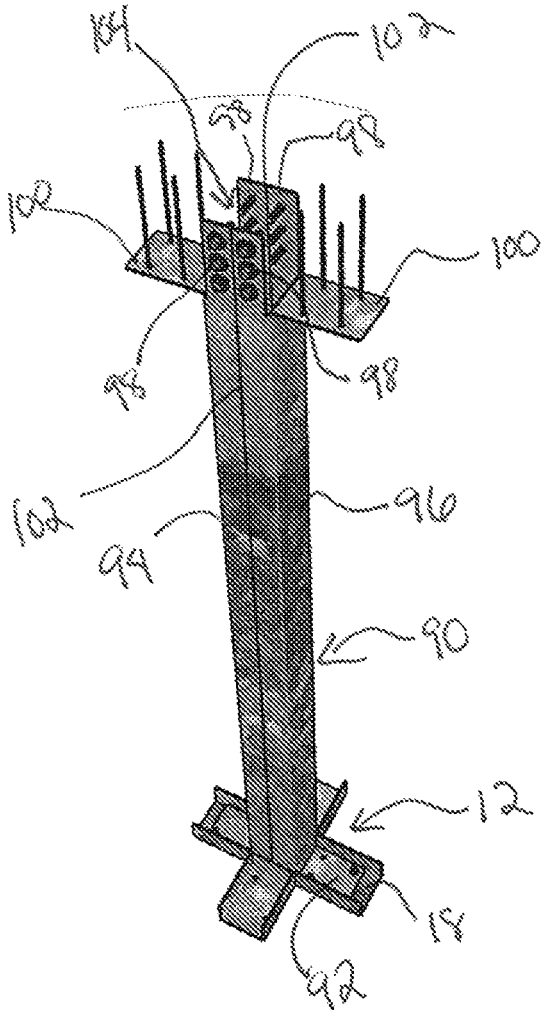
FIG. 7 is a top front side perspective view of an alternate embodiment of the disclosure.

FIGS. 1, 3, and 6 each show additional openings 82 extending through the bottom wall 20 of each of the arms 18. These openings 82 facilitate attachment of structures directly to the arms 18 including a variation of the cradle 14 as can be seen in FIG. 7 labeled as cradle 90. In this embodiment, the cradle 90 may be vertically elongated and have flanges 92 coupled to the arms 18. First section 94 and second section 96 of cradle 90 may have apertured extensions 98 facilitating connection to the building support in an elevated position relative to the base 12. Lateral connection flanges 100 may also be coupled to, integrally or otherwise, the first section 94 and second section 96 and extend perpendicularly from the first section 94 and second section 96 to be secured to an underside of a lateral extension from the building support. The first section 94 and second section 96 are oppositely positioned defining a similar channel 104 and gaps 102 like described above.

In FIG. 6, the first section 56 and second section 58 are shown not completely folded prior to assembly of the cradle 14. Flanges 84 would be folded to be perpendicular to the associated medial panel 74,76 and then first section 56 and second section 58 coupled to the base 12 to form the cradle 14 as described above.

In use, the base 12 and cradle 14 are positioned within a conventional void extended into a support surface. The void is prepared similarly to conventional footing preparations. The device 10 is coupled to the building support 28. As exemplified in FIG. 5, the building support 28 may be a plurality of conventional wood beams 78 in which the attachment to the cradle 14 assists in coupling of the beams together. The building support 28 may also be constructed of metal defining a beam 80. The device 10 and bottom portion of the building support 28 may be secured within the void using concrete or other conventional materials or methods. The device 10 provides for increased lateral stability, base support, and upheaval resistance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A footing anchor device comprising:

a base, said base having a central section and a plurality of arms extending from said central section, each of said arms having a bottom wall and a pair of opposed lateral walls extending upwardly from respective side edges of said bottom wall; and a cradle coupled to said base, said cradle being aligned with and extending upwardly from said central section, said cradle having first section and a second section, each of said first section and said second section being elongated and coupled to said base, said first section being positioned opposite said second section and extending up from said central section of said base, said first section being spaced from said second section defining a pair of gaps between said first section and said second section on opposite sides of said channel, each of said gaps being perpendicular to said central section of said base, each of said first section and said second section having respective apertured extensions wherein said first section and said second section are each configured for being secured to a building support, each of said first section and said second section having a respective lateral connection flange extending perpendicularly from said respective one of said first section and said second section wherein said cradle is configured for being secured to an underside of a lateral extension from the building support.

* * * * *